US005673805A

United States Patent [19]

Chaffin

[11] Patent Number: 5,673,805

[45] Date of Patent: Oct. 7, 1997

[54] JIB PIN ALIGNMENT JACK ASSEMBLY

[75] Inventor: Brian Harry Chaffin, Palmyra, Nebr.

[73] Assignee: National Crane Corporation, Waverly, Nebr.

[21] Appl. No.: 395,589

[22] Filed: Feb. 28, 1995

[51] Int. Cl.[6] ..... B66C 23/42; B66C 23/66

[52] U.S. Cl. ..... 212/347; 212/294; 212/348

[58] Field of Search ..... 212/175–177, 212/294, 295, 181, 297, 299, 300, 347, 348, 901; 224/323, 325, 545

[56] References Cited

U.S. PATENT DOCUMENTS

| | | | |
|---|---|---|---|
| 2,151,338 | 3/1939 | Shonnard | 212/901 |
| 2,699,875 | 1/1955 | Stratton | 212/901 |
| 3,084,806 | 4/1963 | Staples | 212/295 |
| 3,367,512 | 2/1968 | Kaplan | 212/901 |
| 3,785,505 | 1/1974 | Keller | 212/144 |
| 3,831,771 | 8/1974 | Wiencek | 212/348 |
| 3,939,988 | 2/1976 | Wellman | 212/297 |
| 4,483,447 | 11/1984 | Bernabe, Jr. | 212/188 |
| 4,558,791 | 12/1985 | Mosley | 212/347 |
| 4,595,108 | 6/1986 | Koizumi et al. | 212/267 |
| 4,621,742 | 11/1986 | Rathi | 212/177 |
| 4,953,724 | 9/1990 | Koizumi | 212/188 |
| 5,064,078 | 11/1991 | Van Staveren | 212/901 |
| 5,111,945 | 5/1992 | Hull et al. | 212/168 |
| 5,135,118 | 8/1992 | Koizumi | 212/267 |
| 5,193,698 | 3/1993 | Koizumi | 212/168 |

FOREIGN PATENT DOCUMENTS

| | | | |
|---|---|---|---|
| 1367962 | 6/1964 | France | 212/295 |
| 1431909 | 6/1969 | Germany | 212/297 |
| 182695 | 7/1990 | Japan | 212/347 |
| 216499 | 9/1991 | Japan | 212/348 |

*Primary Examiner*—Karen B. Merritt

*Attorney, Agent, or Firm*—Birch, Stewart, Kolasch & Birch, LLP

[57] ABSTRACT

A jib pin alignment jack assembly for aligning the apertures on the proximate end of a jib with apertures on the nose assembly of a boom section to facilitate the manual insertion of pins therein for holding the jib in the operative position relative to the boom section. A manually actuated hydraulic jack is mounted on the underside of the jib at the proximate end thereof, and the jack saddle is extendable to push against the nose assembly on the boom section, to thereby align the apertures for insertion of pins therein. One person is able to not only actuate the hydraulic jack to align the apertures but also insert the pin in the aligned apertures.

9 Claims, 4 Drawing Sheets

1
2
2a
2c
2d
3
4
5
6
7
9
10
10a
10b
11
11a
11b
12
12a
12b
12c
13
13a
13b
13c
14
15a
15b
15c
15d
15h
15i
15j
16
16b
17

JIB PIN ALIGNMENT JACK ASSEMBLY

BACKGROUND OF THE INVENTION

To extend the reach of crane booms having telescopic boom sections, a side stowable jib or boom extension is provided for connection to the nose assembly of the fly section or next adjacent boom section, as disclosed in U.S. Pat. Nos. 3,785,505, dated Jan. 15, 1974, and 4,483,447, dated Nov. 20, 1984.

When moving the boom extension from the stowed position on the side of the telescopic boom, to the operative position, wherein the boom extension extends outwardly in alignment with the longitudinal axis of the boom, the boom extension is pivotally connected to one side of the nose assembly of the boom section and then swung around and connected to the other side of the nose assembly. The connections are made by a plurality of pins extending through aligned holes provided in the cooperating end portions of the boom extension and nose assembly of the fly section.

Due to manufacturing tolerances and shifting of weight, misalignment may occur between the pin connection holes making it difficult, if not impossible, to insert at least the last pin. To facilitate the insertion of the pin by aligning the cooperating holes, U.S. Pat. No. 5,111,945, dated May 12, 1992, discloses the use of an abutment assembly mounted on the nose assembly of the boom section, and another abutment assembly mounted on another boom section. The abutment assemblies engage each other during relative retracting movement of the boom sections to forcibly engage the end of the boom extension to align the holes provided in the cooperating end portions of the boom extension and nose assembly of the fly section to facilitate the insertion of the pin therein.

While the alignment device disclosed in the above mentioned patent has been satisfactory for its intended purpose, the alignment procedure required at least two persons, one in the crane cab to operate the controls for actuating the hydraulic cylinder for retraction of the boom section, and the other to observe when the holes are aligned for insertion of the pin.

After considerable research and experimentation, the jib pin alignment jack assembly of the present invention has been devised requiring the manipulation of only one person to align the holes in the cooperating end portions of the boom extension and nose assembly of the fly section, and to insert the pin therein.

SUMMARY OF THE INVENTION

The jib pin alignment jack assembly of the present invention comprises, essentially, a manually actuated hydraulic jack mounted on the underside of the jib at the proximate end thereof. The jack saddle is extendable in a direction toward the distal end of the fly section pushes against the nose assembly on the fly section, to thereby align the pin holes on the jib and fly section for insertion of the pin therein. By this construction and arrangement, one person can not only actuate the hydraulic jack but also can observe when the pin holes are aligned for receiving the pin, whereby the jib is held in the operative position.

DESCRIPTION OF THE PREFERRED EMBODIMENT

Figure 1:
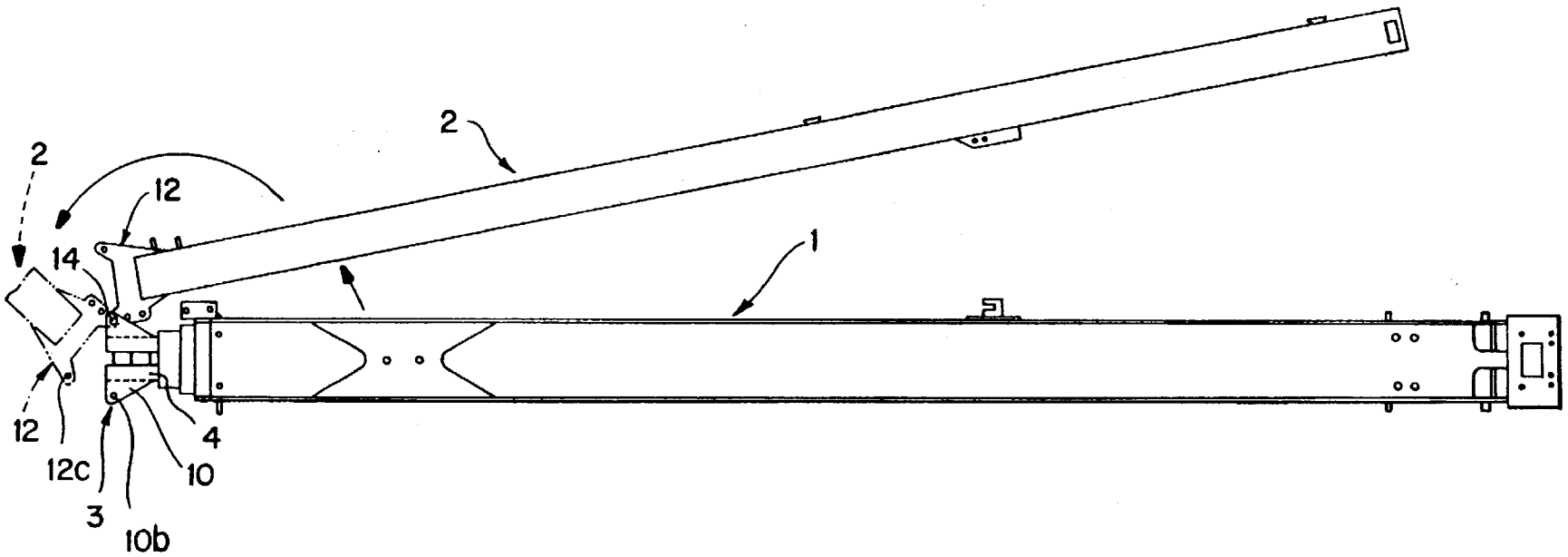
FIG. 1 is a top plan view of a telescopic crane boom having a side stowable jib or boom extension, moveable from the stowed position to an operative position on the nose portion of a boom section.
Figure 2:
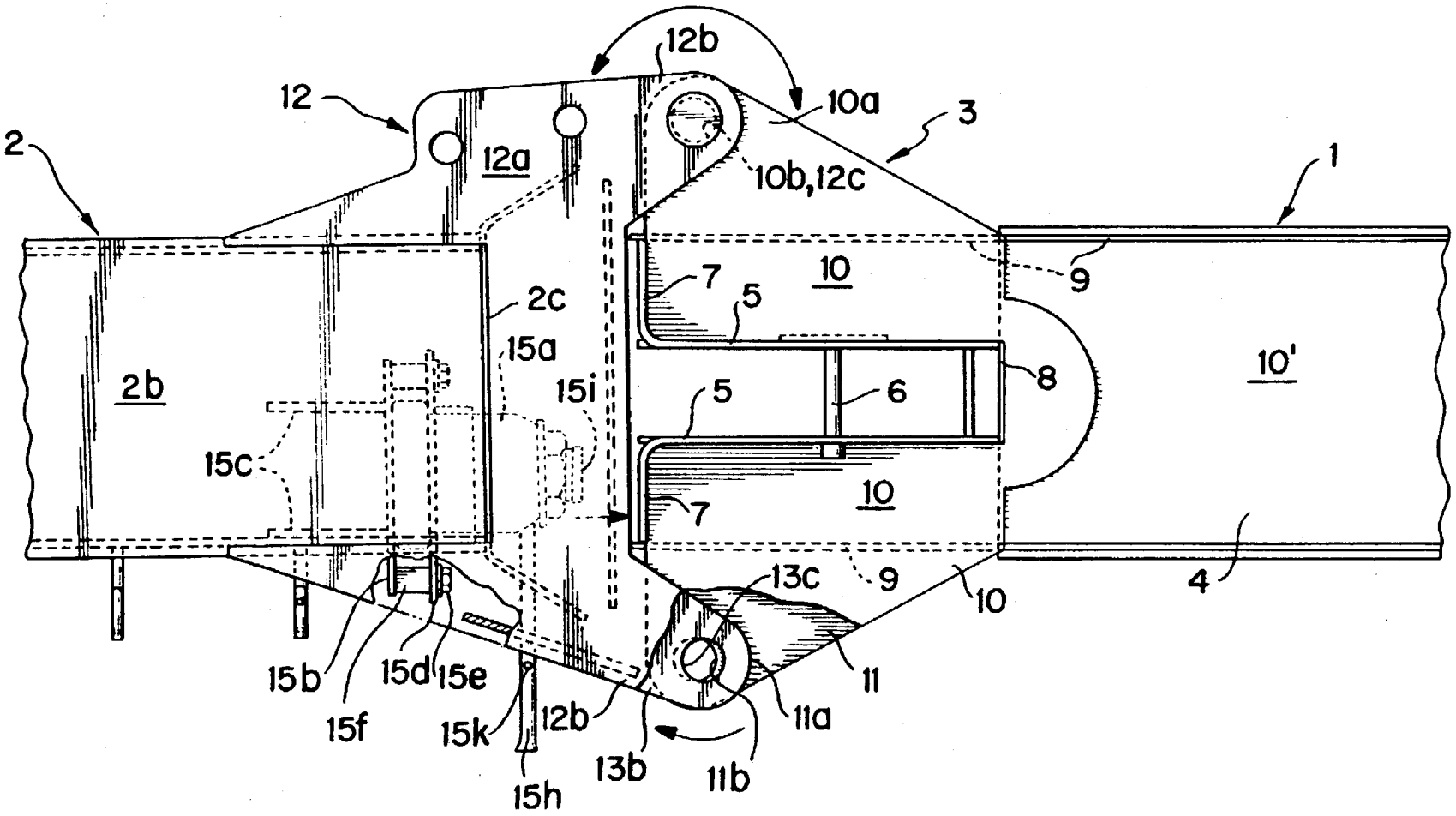
FIG. 2 is an enlarged, fragmentary top plan view, partly broken away, showing the jib partly connected to the nose assembly of the boom section, and showing the misalignment of the bottom and last pin holes.
Figure 3:
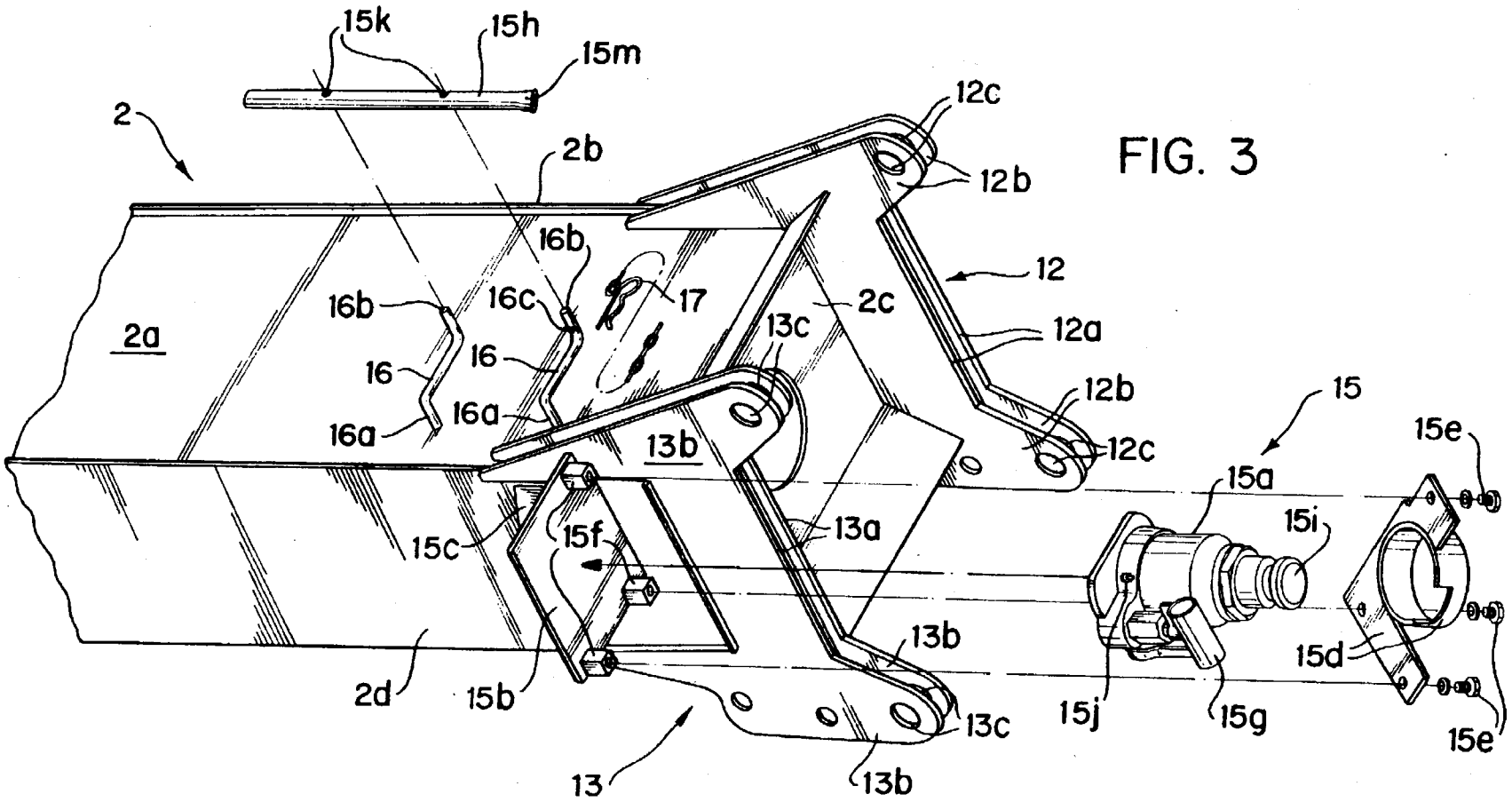
FIG. 3 is a fragmentary, exploded view, as seen from underneath the proximate end portion of the jib, showing the hydraulic jack and mounting bracket.

Referring to the drawings in greater detail, and more particularly to FIGS. 1, 2 and 3, it is conventional to provide a crane boom having a plurality of telescopic boom sections 1 with a side stowable jib or boom extension 2 for connection to the nose assembly 3 on the distal end of the fly section, or outermost section, 4 of the crane boom.

Figures 4, 5:
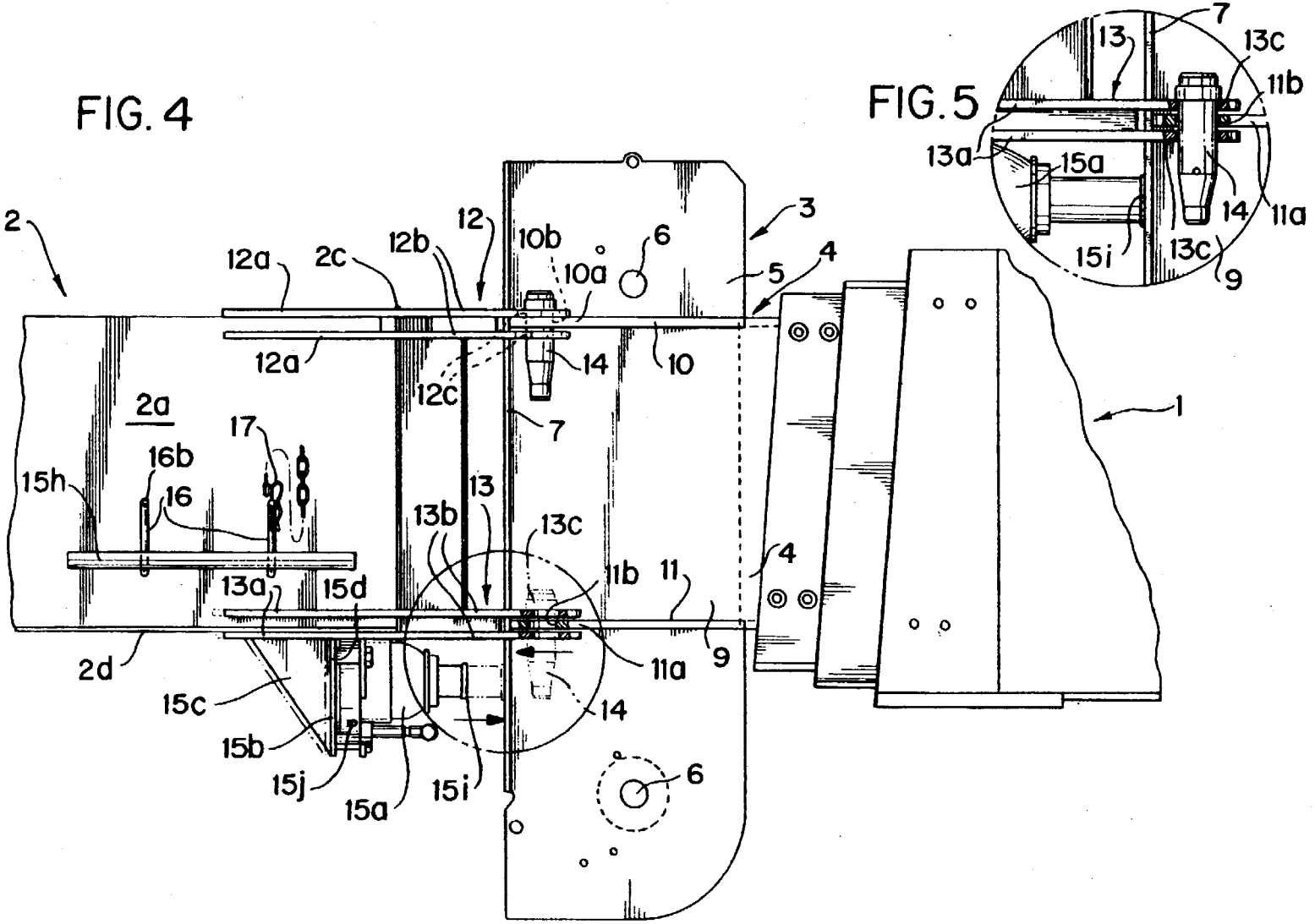
FIG. 4 is a fragmentary side elevational view of the proximate end of the jib and the distal end of the boom section having a nose assembly, with the bottom and last pin holes shown in fragmentary cross-section in the misaligned position, and the actuation of the hydraulic jack pushing the jack saddle against the nose assembly to align the pin holes for insertion of the last pin being shown in phantom.
FIG. 5 is an enlargement of the circled area illustrated in FIG. 4, showing a pin inserted into the aligned holes which are shown in fragmentary cross-section.

As will be seen in FIGS. 2 and 4, the nose assembly 3 comprises a boom sheave housing including a pair of spaced, parallel vertically extending, plates 5 having transversely extending axles 6 mounted therein upon which cable sheaves, not shown, are adapted to be rotatably mounted. The forward edge of each plate 5 is turned outwardly to provide a vertically extending flange 7, and the rearward edges of the plates 5 are integral with a vertically extending plate 8. The laterally outwardly extending edges of the flanges 7 are integral with vertically extending plates 9 which are extensions of the side walls of the fly section 4. A top plate 10 is integral with the top edges of the plates 9, top plate 10' of fly section 4, and the side walls of the plates 5; and a bottom plate 11 is integral with the lower edges of the plates 9, the bottom wall of the fly section, and the side walls of plates 5. The plates 10 and 11 are provided with laterally outwardly extending ear portions 10*a* and 11*a*, on each side, provided with apertures or holes 10*b* and 11*b*, respectively.

Referring to FIGS. 2 and 3, the proximate end of the jib or boom extension 2 comprises an upper clevis 12 and a lower clevis 13. The upper clevis 12 comprises a pair of spaced, parallel plates 12*a* integral with the side walls 2*a*, top wall 2*b* and end wall 2*c* of the jib 2, and extending outwardly therefrom. The plates 12*a* are provided with ear portions 12*b* having aligned holes 12*c* therein. The lower clevis 13 is similarly constructed with plates 13*a* being integral with the jib side walls 2*a*, end wall 2*c* and bottom wall 2*d*, and having ear portions 13*b* provided with aligned holes 13*c*.

As will be seen in FIG. 4, the top and bottom plates 10 and 11 of the nose assembly 3 are positionable in the space between the plates 12*a* of the upper clevis 12 and the plates 13*a* of the lower clevis 13, and pins 14 are inserted through the aligned holes 10*b*, 12*c* and 11*b*, 13*c* for holding jib 2 in the operative position, wherein the jib 2 extends outwardly in alignment with the longitudinal axis of the boom 1. Four pins 14 are employed, and, due to manufacturing tolerances and torquing of the jib, misalignment may occur between the holes 10*b*, 12*c* and 11*b*, 13*c* making it difficult to insert at least the last pin 14, i.e. through the lower left side holes 11*b*, 13*c*.

To facilitate the insertion of the last pin 14, the pin hole alignment jack assembly 15 of the present invention has been devised, and, as seen in FIGS. 3 and 4, comprises a manually actuated hydraulic jack 15*a* mounted on a depending base plate 15*b* secured to the bottom wall 2*d* of the jib 2 by gusset plates 15*c*. The jack 15*a* is secured to the base plate 15*b* by a bracket 15*d* encircling the jack 15*a* and fastened by bolts 15*e* insertable into threaded bores in corner spacer posts 15*f* on the base plated. Jack 15*a* is a conventional manually actuated hydraulic jack having a socket 15*g* for receiving one end of an operating handle 15*h* for extending the jack saddle 15*i*. A manual screw type jack could also be used within the scope of this invention, but a hydraulic jack is preferred. A conventional release valve 15*j* is also provided for relieving the hydraulic pressure within the jack 15*a* for retraction of the saddle 15*i*. The handle 15*h* is stored on the side of the jib 2 by a pair of spaced parallel pins 16, each having one end 16*a* bent inwardly and connected integral with the jib side wall 2*a*, whereby the pins 16 are held outwardly from the jib side wall 2*a*. The opposite ends 16*b* of the pins 16 are bent outwardly relative to the jib side wall 2*a*, and are adapted to be inserted through spaced apertures 15*k* provided in the handle 15*h*. To retain the handle 15*h* in the stored position (FIG. 4) on the pins 16, a tethered spring clip 17 is provided for insertion into a hole 16*c* provided in the end 16*b* of one of the pins 16.

In the operation of the jib pin alignment jack assembly of the present invention, after the upper and lower clevis connections 12 and 13 are made on one side of the jib 2, by insertion of a pair of pins 14 therethrough, as viewed in FIG. 1, the jib 2 is then swung around to its outwardly extending working position and the upper clevis connection 12 is made on the opposite side of the jib 2 by insertion of a pin 14 through the aligned apertures 10*b*, and 12*c* while the apertures 11*b* and 13*c* at the lower clevis connection 13 remain misaligned as shown in FIGS. 2 and 4. To align these apertures for insertion of a pin 14 therethrough, the crane operator removes the handle 15*h* from the stored position on the side wall 2*a* of the jib 2 and inserts it into the hydraulic jack socket 15*g*.

The jack 15*a* is manually actuated with the jack handle to extend the jack saddle 15*i* into abutting relationship with the vertically extending flange 7, on the nose assembly 3. Continued actuation of the jack 15*a* will result in a reaction resulting in the lower clevis 13 being moved to the position shown in FIG. 4, whereby the apertures 11*b* and 13*c* become aligned for insertion of the pin 14 therethrough, as shown in FIG. 5.

After the last pin 14 is inserted, the handle 15*h* is removed from jack socket 15*g*, and its slightly flattened hollow end 15*m* is inserted over the end of release valve 15*j* and is rotated to relieve hydraulic pressure in the jack 15*a* so that saddle 15*i* is no longer pressing against flange 7 during use of the crane. The handle 15*h* is then connected back onto the spaced storage pins 16 and retained there by tethered spring clip 17, until it is possibly needed to remove the pins 14, after use of the jib is completed, to return the jib 2 to its stowed position alongside the telescopic boom 1.

Due to the possible misalignment of the apertures 11*b* and 13*c* in the lower clevis connection 13, there may be a continued slight misalignment after the pin 14 has been inserted, and the biasing force of the hydraulic jack assembly 15 has been removed. Therefore, when the jib 2 is to be pivoted to the stowed position, the hydraulic jack assembly 15 will be actuated as described hereinabove to once again align the apertures 11*b* and 13*c*, to relieve the friction pressure from pin 14, to facilitate the removal of the pin 14 therefrom.

From the above description it will be readily appreciated by those skilled in the art that the jib pin alignment jack assembly of the present invention can be retrofitted on existing crane booms, and by the construction and arrangement of the jack assembly, one person can not only actuate the hydraulic jack but can also insert the pin when the clevis apertures on the jib and nose assembly on the boom section become aligned.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. In a crane boom having at least one boom section with a distal end, a nose assembly on the distal end of said boom section having apertured upper and lower plates of upper and lower clevis connections, a side stowable boom extension having a top wall, a bottom wall, a pair of side walls, and a proximate end, upper and lower apertured spaced plates of upper and lower clevis connections on said proximate end, said side stowable boom extension swingable from a stowed position to a working position and connectable to said nose assembly by said upper and lower clevis connections including said apertured spaced plates on the proximate end of said boom extension insertable on said apertured upper and lower plates on the nose assembly, the improvement comprising a manually actuated lack assembly mounted on the bottom wall at the proximate end of the boom extension, said jack assembly including a jack, a depending base plate secured to the bottom wall of said boom extension, a bracket encircling said jack, a plurality of posts having threaded bores integral with the base plate, bolts extending through said bracket into said threaded bores for securing said jack to the base plate, said jack having a saddle adapted to engage a portion of the nose assembly on the boom section, whereby upon actuation of said jack assembly, the saddle is extended to abut the nose assembly portion to align the apertures on the boom extension with the apertures on the nose assembly to facilitate the insertion of a pin through the aligned apertures.

2. In a crane boom having at least one boom section with a distal end, a nose assembly on the distal end of said boom section having apertured upper and lower plates of upper and lower clevis connections, a side stowable boom extension having a top wall, a bottom wall, a pair of side walls, and a proximate end, upper and lower apertured spaced plates of upper and lower clevis connections on said proximate end, said side stowable boom extension swingable from a stowed position to a working position and connectable to said nose assembly by said upper and lower clevis connections including said apertured spaced plates on the proximate end of said boom extension insertable on said apertured upper and lower plates on the nose assembly, the improvement comprising a manually actuated jack assembly mounted on the bottom wall at the proximate end of the boom extension, said jack assembly having a saddle adapted to engage a portion of the nose assembly on the boom section, a removable actuating handle for said jack, a pair of spaced, parallel pins mounted on the side wall of said boom extension and positioned outwardly therefrom, a pair of longitudinally spaced apertures provided in said handle, said pins being insertable through said spaced apertures, whereby the pins hold the handle in a stored position on the side wall of said boom extension, whereby upon actuation of said lack assembly, the saddle is extended to abut the nose assembly portion to align the apertures on the boom extension with the apertures on the nose assembly to facilitate the insertion of a pin through the aligned apertures, whereby one person can align the apertures and insert the pin therein.

3. In a crane boom according to claim 2, including tethered spring clip means mounted on the side wall of said boom extension and insertable on at least one of the pins, to thereby retain said handle in the stored position on the pins.

4. In a crane boom having at least one boom section with a distal end, a nose assembly located on a distal end of said boom section, said nose assembly having apertured pairs of upper and lower clevis connections, a side stowable boom extension mounted on said boom section and having a proximate end, said boom extension having pairs of apertured upper and lower clevis connections on said proximate end for mating with said pairs of upper and lower apertures on said boom section, said boom extension being manually swingable about a vertical axis from a stowed position on said boom section to a working position connectable to said nose assembly by mating said upper and lower clevis connections of said boom extension with said upper and lower clevis connections of said nose assembly, and pins for insertion in said apertures, the improvement comprising:

jack means for aligning one of the lower apertures of the clevis connections on the boom extension with one of the corresponding lower apertures of one of the clevis connections on the nose assembly by forcing the proximate end of the boom extension away from the nose assembly to align said apertures and to facilitate the insertion of a pin through the lower aligned apertures, said jack means being mounted on the proximate end of the boom extension, said jack means having an end portion which directly engages said nose assembly to force the proximate end of the boom extension away from the nose assembly to align said apertures.

5. In a crane boom according to claim 4, wherein the jack means includes a hydraulic jack.

6. In a crane boom according to claim 5, wherein a removable actuating handle is provided for said jack, and means for holding the handle in the stored position on the boom extension.

7. In a crane boom according to claim 4, wherein the boom extension has a top wall means, a bottom wall means and a pair of side wall means, said jack means mounted on said bottom wall means of said boom extension.

8. In a crane boom according to claim 7, including a depending base plate secured to the bottom wall means of said boom extension, and bracket means engaging and securing said jack means to said base plate.

9. In a crane boom according to claim 4, in which the clevis connections comprise four clevis connections including two lower clevis connections, and said jack means mounted on said boom extension adjacent one of said two lower clevis connections.

* * * * *